United States Patent [19]

Isobe et al.

[11] Patent Number: 4,902,472

[45] Date of Patent: Feb. 20, 1990

[54] HIGH STRENGTH STAINLESS STEEL

[75] Inventors: Susumu Isobe, Nagoya; Hisao Kamiya, Kariya, both of Japan

[73] Assignee: Daido Tokushuko Kabushiki Kaisha, Aichi, Japan

[21] Appl. No.: 208,784

[22] Filed: Jun. 17, 1988

Related U.S. Application Data

[63] Continuation-in-part of Ser. No. 887,773, Jul. 21, 1986, abandoned.

[30] Foreign Application Priority Data

Jul. 19, 1985 [JP] Japan ..... 60-159536

[51] Int. Cl.[4] ..... C22C 38/42

[52] U.S. Cl. ..... 420/49; 420/35; 420/54

[58] Field of Search ..... 420/35, 49, 54, 60, 420/61; 148/327

[56] References Cited

U.S. PATENT DOCUMENTS 2,850,380 3/1957 Clarke, Jr. ..... 420/60
3,795,507 3/1974 Allen ..... 420/49

FOREIGN PATENT DOCUMENTS 47-8689 3/1972 Japan ..... 420/49
62-20857 1/1987 Japan .

*Primary Examiner*—Deborah Yee
*Attorney, Agent, or Firm*—Sughrue, Mion, Zinn, Macpeak & Seas

[57] ABSTRACT

A high strength stainless steel having a tensile strength of not less than 230 kgf/mm$^2$ is disclosed, which comprises 0.01–0.015 st % of C and/or N, 1.0–4.0 wt % of Cu, 9.5–10.9 wt % of Ni, 12.0–17.0 wt % of Cr, 0.5–2.5 wt % of Al and/or Ti, 0.003–0.011 wt % of B, 0.02–0.2 wt % of Be and the balance of Fe, and has a temperature ($Md_{30}$) of transforming 50% of austenite into martensite under a true strain of 0.3 within a range of from room temperature to −196° C.

3 Claims, 3 Drawing Sheets

HIGH STRENGTH STAINLESS STEEL

This is a continuation-in-part of application Ser. No. 06/887,773 filed July 21, 1986, which is a now abandoned.

BACKGROUND OF THE INVENTION

1. Field of the Invention

This invention relates to a high strength stainless steel suitable for use in components requiring high strength and corrosion resistance in office machines, electrical communication equipments, measurement instruments, automobile parts and the like, such as thin leaf spring, coil spring, antenna, precision thread and so on. More particularly, it relates to high strength stainless steels having a tensile strength of not less than 230 kgf/mm$^2$, which has never been attained in the conventional precipitation hardened stainless steel, through ageing treatment after cold working.

2. Related Art Statement

Heretofore, JIS SUS 301 (0.1%C-17%Cr-7%Ni-Fe) after cold working and SUS 631 (0.07%C-17%Cr-7%Ni-1%Al-Fe) after cold working and ageing are frequently used as a spring material for office machines, electrical communication equipements and the like in view of the corrosion resistance. These stainless steels have strengths of about 190 kgf/mm$^2$ and 210 kgf/mm$^2$ at maximum, respectively. Lately, it is demanded to develop stainless steels for spring having a strength of not less than 230 kgf/mm$^2$ with the tendency of the miniaturization, weight reduction and high performance in the office machines, electrical communication equipments and the like.

In general, however, as the strength of the stainless steel for spring becomes higher, the toughness and ductility become lower, so that it is difficult to form the spring from such a steel by means of a press machine, a coiling machine or the like. Particularly, when the strength exceeds 200 kgf/mm$^2$, there may be caused the breaking of the steel material during the formation of the spring. Therefore, if it is intended to provide the strength of not less than 200 kgf/mm$^2$ at a use state, the steel material is first formed into a spring at such a state that the strength of the steel material is less than 200 kgf/mm$^2$ in order to avoid the breaking of the steel material, and then the increase of the strength should be attained by any method.

Hitherto, metastable austenite-type precipitation hardened stainless steels represented by JIS SUS 631 and 15-7Mo steel (0.02%C-15%Cr-7%Ni-1.2%Al-2.3%Mo-Fe) have been used along the above requirement. This type of the stainless steel is at an austenite state after solution treatment and is drawn to a strength of not more than 200 kgf/mm$^2$ capable of forming of the spring, during which austenite is transformed into martensite. At such a state, the steel is shaped into the spring of a given form, which is then hardened by an ageing treatment.

In the above conventional technique, however, the elemental amounts of Al, Mo and so on precipitated by the ageing treatment are small, so that the tensile strength after the ageing treatment is 220 kgf/mm$^2$ at most.

In order to further increase the tensile strength at the use state, it is effective to increase precipitation hardening elements such as Al, Mo and so on, but as these elements become larger, austenite is stabilized and hardly transformed into martensite even by working.

In order to evaluate the stability of austenite, $Md_{30}$ is used as an indication. This $Md_{30}$ is defined by "temperature of transforming 50% of austenite into martensite under a true strain of 0.3". For instance, T. Angel proposes the following equation (1) as a relationship between $Md_{30}$ and chemical composition of steel:

$$Md_{30}(°C.)=413-462\times[\%C+\%N]-9.2\times[\%Si]-8.1\times[\%Mn]-13.7\times[\%Cr]-7.5\times[\%Ni]-18.5\times[\%Mo] \quad (1).$$

According to the equation (1), for example, if the amount of Mo is increased, when the amounts of Cr and Ni are decreased at a rate corresponding to the decreased rate of $Md_{30}$, the value of $Md_{30}$, the value of $Md_{30}$ can be made unchangable. However, the decreases of Cr and Ni also reduce Ni equivalent and Cr equivalent calculated by the following equations (2) and (3):

$$\text{Ni equivalent}=[\%Ni]+30\times[\%C]+0.5\times[\%Mn]+0.3\times[\%Cu] \quad (2)$$

$$\text{Cr equivalent}=[\%Cr]+[\%Mo]+1.5\times[\%Si]+0.5\times[\%Nb] \quad (3)$$

so that the structure of the steel alloy is closed to martensite+ferrite phase as shown in Schaeffler diagram of FIG. 1. Therefore, the work hardening by the drawing is small, and particularly the hot workability is considerably deteriorated.

Thus, it is very important that in the metastable austenite-type stainless steel, phase transformation temperature is finely controlled for ensuring the stable quality.

SUMMARY OF THE INVENTION

It is, therefore, an object of the invention to solve the aforementioned problems of the conventional techniques and to provide high strength stainless steels, wherein a high tensile strength of not less than 230 kgf/mm$^2$, which has never been attained in the conventional precipitation hardened stainless steel, can be obtained by subjecting the steel material after the working to an ageing treatment without lowering the toughness and ductility of the steel material.

The high strength stainless steel according to the invention comprises 0.01–0.15 wt% of C and/or N, 1.0–4.0 wt% of Cu, 9.5–10.9 wt% of Ni, 12.0–17.0 wt% of Cr, 0.5–2.5 wt% of Al and/or Ti, 0.003–0.011 wt% of B, 0.02–0.2 wt% of Be and the balance being Fe and inevitable impurities and has a temperature ($Md_{30}$) of transforming 50% of austenite into martensite under a true strain of 0.3 within a range of from room temperature to −196° C. and a tensile strength of not less than 230 kgf/mm$^2$ through aging treatment after the working. And the steel further contains 0.05–0.5 wt% in total at least one of V, Nb and Zr or 1.0–4.0 wt% of Mo and 0.05–0.5 wt% in total at least one of V, Nb and Zr if necessary.

BRIEF DESCRIPTION OF THE DRAWINGS

The invention will be described with reference to the accompanying drawings, wherein.

DESCRIPTION OF THE PREFERRED EMBODIMENTS

Figure 1:
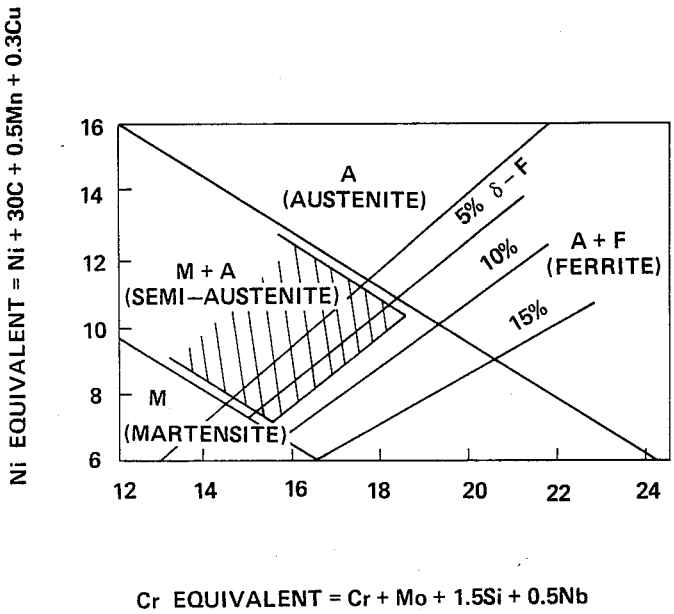
FIG. 1 is a Schaeffler diagram showing the structure region of stainless steel.

The invention will be described in detail below.

The reason why the chemical composition (% by weight) of the high strength stainless steel according to the invention limited to the above range is as follows.

C, N:

C and N are elements effective for reinforcing the matrix of the steel. In order to obtain such an effect, it is necessary to add the element in an amount of not in total preferably not less than 0.028%. However, if the amount is too large, $Md_{30}$ becomes less than −196° C. and the transformation to martensite is hardly caused even by cold working, so that the upper limit should be 0.15% or 0.12% preferably. Therefore, the total amount of C and/or N is within a range of 0.01–0.15% preferably a range of 0.028–0.12%.

Cu:

Cu is an element forming ϵ-Cu phase among precipitates contributing to the age hardening of the steel. This ϵ-Cu phase is finely precipitated from martensite transformed by drawing after solution treatment through ageing at 400°–500° C. The ϵ-Cu phase not only reinforces itself but also forms nucleus for precipitates such as NiAl, $Fe_2Mo$ and the like precipitating at higher temperature, which acts to more enhance the ardening of these fine precipitates. In order to obtain such an action, therefore, it is necessary to add Cu in an amount of not less than 1.0%. However, if the amount is too large, the hot workability is considerably degraded as is well-known, so that the upper limit should be 4.0% or 3.0% preferably.

Ni, Cr:

Ni and Cr are dependently determined by deciding $Md_{30}$, Ni equivalent and Cr equivalent in the high strength stainless steel according to the invention. As a result, the amount of Ni is within a range of 7.0–11.0% and that of Cr is within a range of 12.0–17.0%. However, it is preferable that the amount of Ni and Cr is within a range of 9.5–10.9% and 13.5–16.4% respectively considerably from the corrosion resistance as a stainless steel.

Al, Ti:

Al and Ti are elements forming NiAl phase and NiTi phase as a precipitate contributing to the age hardening. In order to form such precipitate, therefore, it is required to add at least one of Al and Ti in an amount of not less than 0.5% preferably not less than 1.0%. If the amount exceeds 2.5% (2.3% in more strictly speaking), the precipitated grains are coarsened to reduce the strength after the ageing treatment, so that the amount is limited to a range of 0.5–2.5% preferably a range of 1.0–2.3%. Moreover, if the amount of Al and Ti is too large, inclusions such as $Al_2O_3$, AlN, $TiO_2$, TiN and the like increase through atmospheric melting, which particularly decreases the fatigue strength significantly required as a material for springs. Therefore, the upper limit of Al and Ti is 2.5% in total.

B:

B is particularly an important element for improving hot workability of the stainless steel according to the invention. That is, the stainless steel according to the invention contains a large amount of ferrite forming elements such as Al, Ti, V, Nb, Zr, Mo and so on, so that the hot workability is considerably degraded when adding no B. In general, it is desired that metastable austenite stainless steel contains 1–3% of ferrite in order to finely divide crystal grains after the hot working, but if the amount of ferrite exceeds 5%, the hot workability considerably deteriorates. In the stainless steel according to the invention, however, the hot working is made possible by adding not less than 0.001% (preferably not less than 0.003% and more preferably not less than 0.005%) of B even if the ferrite is existent in an amount of 3–10%. If the amount of B is too large, the effect of improving the hot workability rather lowers, so that the upper limit is 0.02% or 0.011% preferably.

Be:

Be is an element effective for the age hardening to more increase the strength. It has been confirmed from investigations that the influence per 0.1% of Be upon the strength after the drawing and age hardening is 40 $kgf/mm^2$ and the effect thereof is fairly large at a slight amount as compared with the case of Cu, Al and the like. However, it has also been confirmed that the Be addition exceeding 0.2% considerably injuries the hot workability. Therefore, the amount of Be added is limited to a range of 0.02–0.2% from the above reasons. Though, it is preferable that the amount of Be is within a range of 0.03–0.075% in order to ensure the effect and minimize the infection of Be. Moreover, when Be is added as a metallic Be in the melting, a part of the addition amount evaporates to harmfully exert on the human body. On the other hand, according to the invention, such a problem is prevented by using a Cu-Be alloy for use in a bearing of instrument (Be content: 2.5%) as a mother alloys to be added.

Mo:

Mo is an element producing $Fe_2Mo$ phase by ageing at 450°–600° C. to more enhance the strength. In order to obtain such an effect, it is necessary to add Mo in an amount of not less than 1.0%. As the amount of Mo added increases, the strength after the age hardening increases, but if the amount exceeds 4.0%, the amount of ferrite produced at high temperature considerably increases to degrade the hot workability, so that the upper limit is 4.0%.

V, Nb, Zr:

V, Nb and Zr are elements necessary for finely dividing crystal grains after the solution treatment. In this connection, Japanese Patent Application No. 53-28052 has disclosed that the fatigue strength of metastable austenite-type stainless steel increases as the strain-induced martensite becomes finer. The inventors have found that the strain-induced martensite becomes finer as the grain size of former-austenite becomes smaller. Further, it has been confirmed that V, Nb, Zr form carbides during the rolling to make the former austenite grain size smaller. In order to obtain such an effect, it is necessary to add at least one of V, Nb and Zr in an amount of not less than 0.1%. If the amount exceeds 0.5%, the addition effect is saturated, so that the upper limit is 0.5%.

Although the high strength stainless steel according to the invention comprises the above defined chemical composition, it is necessary that the temperature ($Md_{30}$) of transforming 50% of austenite into martensite under a true strain of 0.3 is within a range of from room temperature to −196° C. This $Md_{30}$ is usually determined to measuring amount of martensite in specimen by X-ray diffraction method or magnetic permeability method when it is worked at a given temperature under a true strain of 0.3. In this case, the $Md_{30}$ is desirable to be made low for adding the age hardening elements at a large amount as far as possible, but when $Md_{30}$ is too low, there is caused no martensitic transformation even in the working at low temperature, so that it is necessary to be within a range of from room temperature to −196° C.

According to the invention, it has been noticed that the acceptable range of the alloy addition is increased by subjecting the steel of the above composition after the solution treatment to a drawing at low temperature, from which it has been found that high strength stainless steel having a tensile strength of more than 230 kgf/mm$^2$ can be obtained by adding various age hardening elements at once.

The following examples are given in illustration of the invention and are not intended as limitations thereof.

EXAMPLE 1

A steel having a chemical composition as shown in the following Table 1 was melted and shaped into an ingot, which was then rolled to a diameter of 9.5 mm. Next, the rolled rod was subjected to a solution treatment by heating at 1050° C. for 1 hour and cooling in air, and then drawn at a low temperature of +30° to −50° C. at a working ratio of 30%, 52%, 72% or 90%, which was subjected to an ageing treatment under conditions as shown in the following Table 2. In this case, the ageing temperature was selected to a temperature giving a most age hardened amount to the steel specimen. The tensile strength was measured with respect to the steel specimen after the ageing treatment to obtain a result as shown in Table 2.

TABLE 1

| Kind of steel | symbol | Chemical composition (wt %) C | Si | Mn | Cu | Ni | Cr | Al | N | B | Be | Mo |
|---|---|---|---|---|---|---|---|---|---|---|---|---|
| Invention steel | I-1 | 0.08 | 0.15 | 0.31 | 3.0 | 9.6 | 16.4 | 2.0 | 0.003 | 0.003 | 0.05 | — |
| | I-2 | 0.02 | 0.14 | 0.33 | 1.0 | 10.4 | 13.5 | 1.8 | 0.008 | 0.008 | 0.03 | 2.5 |
| Comparative steel | C-1 | 0.02 | 0.35 | 0.32 | 3.0 | 7.5 | 16.4 | 1.3 | 0.003 | — | — | — |
| | C-2 | 0.01 | 0.17 | 0.31 | 3.0 | 9.5 | 15.0 | 2.0 | 0.003 | 0.005 | — | 4.1 |
| | 17-7PH | 0.07 | 0.18 | 0.90 | 0.22 | 8.5 | 16.5 | 1.2 | 0.02 | — | — | — |

TABLE 2

Figure 2:
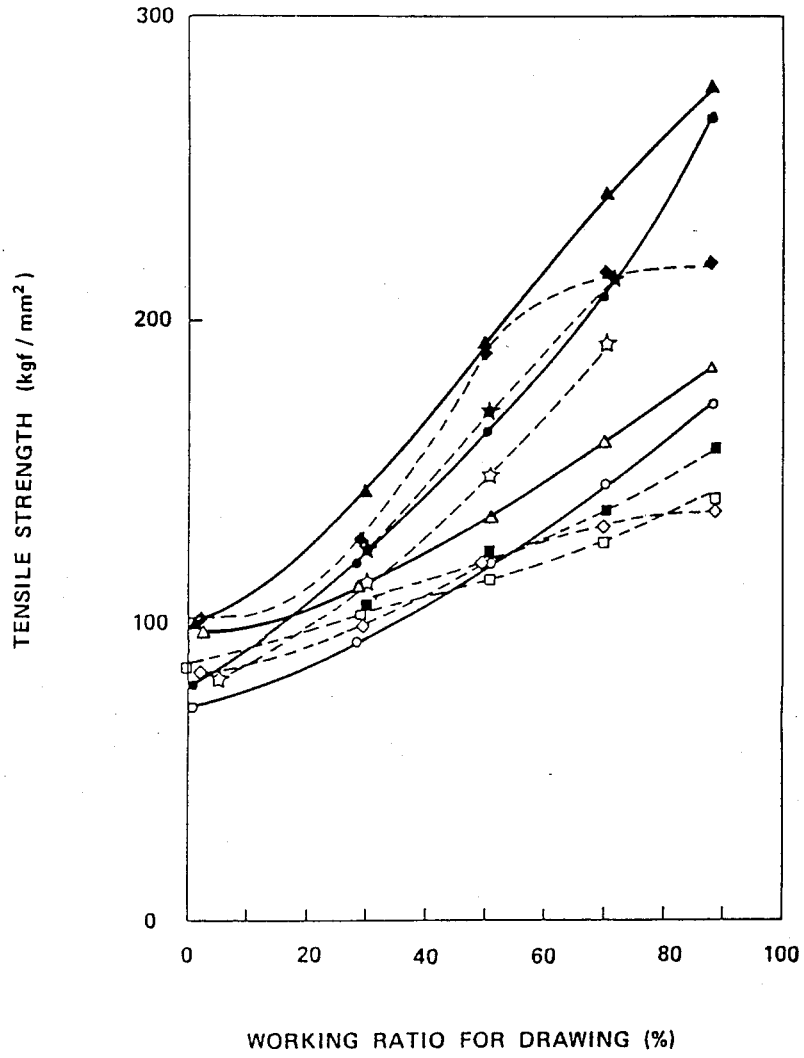
FIG. 2 is a graph showing results on the change of tensile strength at various working ratios for drawing in Examples of the invention.

| Kind of steel | Symbol | Ageing conditions | Mark in FIG. 2 |
|---|---|---|---|
| | I-1 | cooling in air after heating of 475° C. × 1 hr | ● |
| Invention steel | I-1 | drawn state (low temperature) *1 | ○ |
| | I-2 | cooling in air after heating of 525° C. × 1 hr | ▲ |
| | I-2 | drawn state (low temperature) | △ |
| | C-1 | cooling in air after heating of 475° C. × 1 hr | ◆ |
| | C-1 | drawn state (low temperature) | ◇ |
| Comparative steel | C-2 | cooling in air after heating of 525° C. × 1 hr | ■ |
| | C-2 | drawn state (low temperature) | □ |
| | 17-7PH | cooling in air after heating of 475° C. × 1 hr | ★ |
| | 17-7PH | drawn state (room temperature) *2 | ☆ |
| Remarks | *1 +30~−50° C. | | |
| | *2 50~150° C. (temperature rising due to working heat) | | |

As seen from Table 1, 2 and FIG. 2, the invention steel I-1 among steels of Table 1 has $Md_{30}$ of 0° C. and Ms (temperature starting martensitic transformation) of not more than −196° C. Therefore, when this steel is drawn at +30° to −50° C., the martensitic transformation proceeds, during which the austenite amount is about 3% at the working ratio of 90%. Since the age hardened amount of the steel is made large by the addition of Be, the tensile strength of not less than 230 kgf/mm$^2$ is obtained by ageing after the drawing above 80%. Furthermore, the invention steel I-2 is a steel having an age hardened amount increased by addition of Mo, which is also clear to have a large tensile strength.

On the other hand, the comparative steel C-1 has Ms point of 100° C., so that the structure after the solution treatment consists of 50% martensite and 50% austenite. Thus, martensite existent before the working is not hardened even by the working. Therefore, even when this comparative steel is subjected to an ageing treatment, the tensile strength of more than 230 kgf/mm$^2$ can not be obtained. Furthermore, the comparative steel C-2 has $Md_{30}$ below −196° C., so that martensitic transformation is not sufficiently caused even in the drawing at low temperature. As a result, this steel is small in the age hardened amount and has not a tensile strength of not less than 230 kgf/mm$^2$. Moreover, the comparative steel 17-7PH is poor in the drawability owing to the large work hardening, so that cracks are caused by drawing at a working ratio of 70%. And also, the age hardened amount is small, so that the tensile strength of more than 230 kgf/mm$^2$ is not obtained.

EXAMPLE 2

A steel having a chemical composition as shown in the following Table 3 was melted and shaped into an ingot, which was rolled to a diameter of 9.5 mm. Then, the rolled rod was subjected to a solution treatment by heating at 1050° C. for 1 hour and cooling in air and then drawn at a low temperature of −50° to −100° C. at a working ratio of 82%, which was then subjected to an ageing treatment by heating at 475° C. for 4 hours and cooling in air. Thereafter, the steel specimen after the ageing treatment was subjected to a tensile test, whereby the tensile strength, elongation and reduction of area were measured. The resulting results are shown in the following Table 4.

TABLE 3

| Kind of steel | symbol | Chemical composition (wt %) C | Si | Mn | Cu | Ni | Cr | Be | Mo | Al | Ti | N | B | V | Nb | Zr |
|---|---|---|---|---|---|---|---|---|---|---|---|---|---|---|---|---|
| | I-3 | 0.09 | 0.18 | 0.34 | 2.0 | 9.6 | 16.4 | 0.05 | — | 2.0 | — | 0.005 | 0.010 | <0.01 | — | — |
| | I-4 | 0.07 | 0.20 | 0.40 | 3.0 | 9.6 | 16.3 | 0.075 | — | 2.0 | — | 0.005 | 0.011 | <0.01 | — | — |
| | I-5 | 0.10 | 0.25 | 0.41 | 1.4 | 9.5 | 13.5 | 0.03 | 1.8 | 2.3 | — | 0.02 | 0.005 | <0.01 | — | — |
| | I-6 | 0.01 | 0.12 | 0.51 | 2.0 | 9.6 | 15.8 | 0.03 | 1.0 | 1.3 | — | 0.10 | 0.008 | <0.01 | — | — |
| Invention | I-7 | 0.08 | 0.15 | 0.31 | 1.5 | 9.6 | 15.0 | — | — | 0.7 | 1.0 | 0.01 | 0.008 | 0.2 | — | — |
| steel | I-8 | 0.08 | 0.15 | 0.31 | 2.0 | 9.8 | 15.0 | 0.07 | — | 1.0 | — | 0.02 | 0.007 | <0.01 | 0.2 | — |
| | I-9 | 0.08 | 0.15 | 0.32 | 3.0 | 10.9 | 13.5 | 0.04 | 3.0 | 0.6 | 1.0 | 0.01 | 0.008 | 0.2 | — | — |
| | I-10 | 0.07 | 0.15 | 0.31 | 1.6 | 9.5 | 16.2 | 0.05 | 1.5 | 1.0 | — | 0.01 | 0.007 | <0.01 | 0.2 | — |
| | I-11 | 0.07 | 0.15 | 0.34 | 1.5 | 9.7 | 16.2 | 0.07 | 1.5 | 1.1 | — | 0.01 | 0.005 | <0.05 | 0.05 | — |
| | I-12 | 0.08 | 0.15 | 0.29 | 1.5 | 9.9 | 16.0 | 0.06 | 1.5 | 1.1 | — | 0.01 | 0.008 | <0.01 | — | 0.05 |
| | I-13 | 0.08 | 0.15 | 0.31 | 1.5 | 9.8 | 16.0 | 0.04 | 1.5 | 1.0 | — | 0.02 | 0.006 | <0.07 | 0.07 | 0.09 |
| Comparative | C-3 | 0.09 | 0.18 | 0.34 | 3.1 | 9.7 | 16.2 | — | — | 1.9 | — | 0.005 | — | <0.01 | — | — |
| steel | C-4 | 0.05 | 0.17 | 0.32 | 2.7 | 9.7 | 15.5 | — | — | 3.0 | — | 0.01 | — | 0.1 | — | — |

TABLE 4

| Kind of steel | Symbol | Md30 (°C.) | Tensile strength (kgf/mm²) | Elongation (%) GL = 4D | Reduction of area (%) |
|---|---|---|---|---|---|
| | I-1 | 0 | 232 | 11 | 39 |
| | I-3 | 23 | 248 | 8 | 29 |
| | I-4 | −5 | 256 | 7 | 23 |
| | I-5 | 21 | 241 | 9 | 32 |
| Invention | I-6 | 6 | 235 | 12 | 42 |
| steel | I-7 | 28 | 244 | 6 | 23 |
| | I-8 | 20 | 261 | 6 | 21 |
| | I-9 | −57 | 265 | 7 | 24 |
| | I-10 | 7 | 262 | 7 | 27 |
| | I-11 | 14 | 276 | 8 | 26 |
| | I-12 | 10 | 260 | 6 | 18 |
| | I-13 | 3 | 253 | 13 | 41 |
| Comparative | C-3 | | 228 | 4 | 20 |
| steel | C-4 | | 180 | 8 | 33 |

As seen from Table 3 and 4, the invention steels I-3, 4 are steels obtained by adding 0.05% and 0.075% of Be to the comparative steel C-3, respectively, whose tensile strength after the ageing treatment being higher than that of the comparative steel C-3 owing to the addition of Be. Furthermore, the invention steel I-5 is obtained by adding Mo to the comparative steel, the invention steel I-6 is obtained by adding Mo and Be to the comparative steel, whereby the tensile strength is increased. Further, it is clear from the invention steel I-6 that the addition of N is effective for the enhancement of matrix.

In the invention steels I-7 and I-9, a part of Al is replaced with Ti and in this case, the high strength of more than 230 kgf/mm² is obtained, and particularly the steel I-9 containing a large amount of Cu shows a fairly high strength.

In the invention steels I-8 and I-10~13, a part of V is replaced with Nb, Zr in addition to Be alone or Be and Mo with complex, wherein the tensile strength is more than 230 kgf/mm². Particularly, the invention steel I-13 containing V, Nb and Zr with Be, Mo is fairly high in the ductility.

On the contrary, the comparative steel C-3 has a tensile strength of less than 230 kgf/mm² and is low in the ductility. In the comparative steel C-4, NiAl is coaresend to considerably lower the tensile strength. Moreover, the occurrence of cracks in the hot working is conspicuous in the comparative steels C-3 and 4.

EXAMPLE 3

Using the invention steel I-1 in Table 1, the invention steels I-2, I-4 and I-9 in Table 2, and the comparative steel C-5 having a chemical composition as shown in the following Table 5, a confirmation of the effect of B on the hot workability was performed.

TABLE 5

| Kind of steel | Symbol | Chemcal composition (wt %) C | Si | Mn | Cu | Ni | Cr | Al | N | B | Be | Mo |
|---|---|---|---|---|---|---|---|---|---|---|---|---|
| Comparative Steel | C-5 | 0.07 | 0.21 | 0.28 | 2.9 | 9.7 | 16.3 | 2.1 | 0.005 | 0.0012 | 0.06 | 0.02 |

Each of the steels was melted and shaped into an ingot, which was then rolled into a rod having a diameter of 9.5 mm.

A specimen was machined from the rod.

Next, the hot workability was evaluated by a high temperature and high speed tensile test at respective temperature using the specimen.

Figure 3:
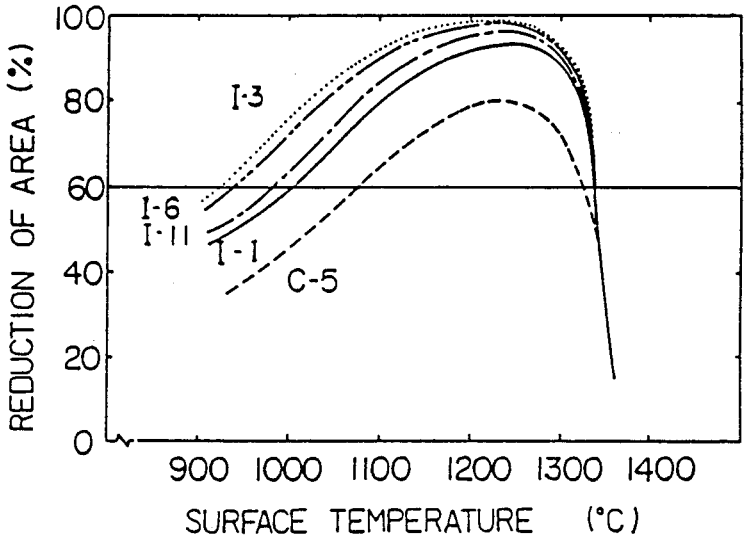
FIG. 3 is a graph showing the effect of B content in the steel on the high temperature and high speed tensile test properties.

FIG. 3 is a graph showing the value of reduction of area of respective steels by said high temperature and high speed tensile test.

The hot workability of materials becomes more excellent with higher peak value and wider peak width of the reduction of area. It is said that the rolling and blooming can be performed satisfactorily at the temperature region that the value of reduction of area is not less than 60% empirically.

As seen from the FIG. 3, by comparing the value of reduction of area of respective invention steels I-1, I-2, I-4 and I-9 containing the B not less than 0.003 wt% with that of comparative steel C-5 containing the 0.0012 wt% of B, the reduction of area of respective invention steels is larger than that of comparative steel C-5 in the peak value and peak width, thus it is clear that an excellent hot workability of the steel can be obtained by addition of a proper amount of B.

As mentioned above, the high strength stainless steel according to the invention comprises 0.01–0.15% of C and/or N, 1.0–4.0% of Cu, 9.5–10.9% of Ni, 12.0–17.0% of Cr, 0.5–2.5% of Al and/or Ti, 0.003–0.011 of B, 0.02–0.2% of Be and the balance being Fe and inevitable impurities, and has a temperature (Md30) of transforming 50% of austenite into martensite under a true strain of 0.3 within a range of from room temperature to −196° C. and a tensile strength of not less than 230 kgf/mm$^2$ through aging treatment after the working. And the steel further contains 0.05–0.5% in total of at least one of V, Nb and Zr or 1.0–4.0% of Mo and 0.05–0.5% in total of at least one of V, Nb and Zr if necessary, so that considerably high tensile strength of not less than 230 kgf/mm$^2$, which has never been attained in the conventional precipitation hardened stainless steel, can be obtained by an ageing treatment after the proper working without lowering toughness and ductility of the steel material. Further, the steels according to the invention can be favorably be used as a material for components requiring high strength and corrosion resistance in office machines, electrical communication equipments, measurement instruments, automobile parts and the like, such as thin leaf spring, coil spring, antenna, precision thread and so on. Moreover, the steels according to the invention can satisfy the requirements for miniaturization weight reduction and high performances of various equipment.

What is claimed is:

1. A high strength stainless steel comprising 0.01–0.15 wt% in total of at least one of C and N, 1.0–4.0 wt% of Cu, 9.5–10.9 wt% of Ni, 12.0–17.0 wt% of Cr, 0.5–2.5 wt in total of at least one of Al and Ti, 0.005–0.011 wt% of B, 0.02–0.2 wt% of Be and the balance of being Fe and inevitable impurities, and having a temperature ($Md_{30}$) of transforming 50% of austenite into martensite under a true strain of 0.3 within a range of from room temperature to −196° C. and a tensile strength of not less than 230 kgf/mm$^2$ through aging treatment after the working.

2. A high strength stainless steel comprising 0.01–0.15 wt% in total of at least one of C and N, 1.0–4.0 wt% of Cu, 9.5–10.9 wt% of Ni, 12.0–17.0 wt% of Cr, 0.5–2.5 wt% in total of at least one of Al and Ti, 0.005–0.011 wt% of B, 0.02–0.2 wt% of Be, 0.05–0.5 wt% in total of at least one of V, Nb and Zr, and the balance being Fe and inevitable impurities, and having a temperature ($Md_{30}$) of transforming 50% of austenite into martensite under a true strain of 0.3 within a range of from room temperature to −196° C., and a tensile strength of not less than 230 kgf/mm$^2$ through aging treatment after the working.

3. A high strength stainless steel comprising 0.01–0.15 wt% in total of at least one of C and N, 1.0–4.0 wt% of Cu, 9.5–10.9 wt% of Ni, 12.0–17.0 wt% of Cr, 0.5–2.5 wt% in total of at least one of Al and Ti, 0.005–0.011 wt% of B, 0.02–0.2 wt% of Be, 1.0–4.0 wt% of Mo, 0.05–0.5 wt% in total of at least one of V, Nb and Zr, and the balance being Fe and inevitable impurities, and having a temperature ($Md_{30}$) of transforming 50% of austenite into martensite under a true strain of 0.3 within a range of from room temperature to −196° C., and a tensile strength of not less than 230 kgf/mm$^2$ through aging treatment after the working.

* * * * *